US005843335A

United States Patent [19]

Kurono et al.

[11] Patent Number: 5,843,335

[45] Date of Patent: Dec. 1, 1998

[54] DILATANCY LIQUID

[75] Inventors: Koichi Kurono, Toyota; Masamine Tanikawa, Okazaki; Masahiro Ogawa, Toyoake, all of Japan

[73] Assignee: Toyota Jidosha Kabushiki Kaisha, Aichi-ken, Japan

[21] Appl. No.: 600,640

[22] Filed: Feb. 13, 1996

[30] Foreign Application Priority Data

Feb. 14, 1995 [JP] Japan ..... 7-025722

[51] Int. Cl.[6] ..... B01J 13/00

[52] U.S. Cl. ..... 252/315.2; 137/13; 252/74; 252/309; 252/313.1; 252/313.2; 252/315.01; 252/315.6; 252/315.7

[58] Field of Search ..... 137/13; 507/269, 507/527; 252/74, 309, 313.1, 313.2, 315.01, 315.2, 315.6, 315.7; 264/15

[56] References Cited

U.S. PATENT DOCUMENTS

| | | | |
|---|---|---|---|
| 2,668,149 | 2/1954 | Iler | 252/313.2 |
| 2,765,242 | 10/1956 | Alexander et al. | 252/315.6 |
| 2,965,172 | 12/1960 | Da Roza | 166/42 |
| 2,984,629 | 5/1961 | Loftman et al. | 252/313.2 |
| 3,250,726 | 5/1966 | Martinek et al. | 252/74 X |
| 3,412,031 | 11/1968 | Martin et al. | 252/75 |
| 3,634,288 | 1/1972 | Youngs | 252/313.2 X |
| 3,714,107 | 1/1973 | Smith | 523/220 |
| 4,316,807 | 2/1982 | McDaniel et al. | 252/315.2 X |
| 5,116,535 | 5/1992 | Cochrane | 252/313.2 |
| 5,294,426 | 3/1994 | Sekine et al. | 423/335 |
| 5,324,767 | 6/1994 | Koyama et al. | 524/493 |

FOREIGN PATENT DOCUMENTS

| | | |
|---|---|---|
| 0 174 566 | 3/1986 | European Pat. Off. . |
| 0 341 737 | 11/1989 | European Pat. Off. . |
| 2-69315 | 3/1990 | Japan . |
| 2-504528 | 12/1990 | Japan . |
| 5-237367 | 9/1993 | Japan . |
| WO 89/12182 | 12/1989 | WIPO . |

OTHER PUBLICATIONS

Database WPI, Section Ch, Week 9011, Derwent Publications Ltd., London, GB; Class A85, AN 90–080394, XP 002029154 & JP 02 691 A, Feb. 5, 1990, (abstract) (1 page).
European Search Report dated Apr. 11, 1997 (2 pages).
Communication dated May 9, 1997 (1 page).

*Primary Examiner*—Richard D. Lovering
*Attorney, Agent, or Firm*—Finnegan, Henderson, Farabow, Garrett & Dunner L.L.P.

[57] ABSTRACT

A dilatancy liquid is a sol under a low shear stress and a gel under a high shear stress, and includes inorganic particles having a roundness of 1.1 or less, and a particle diameter of from 0.05 to 5 $\mu$m, and a liquid held among the inorganic particles. The dilatancy liquid is of high mechanical strength, and exhibits a low viscosity under a low shear stress and a high viscosity under a high shear stress; namely: it exhibits a large viscous-resistance variation by a shear-stress increment.

15 Claims, 6 Drawing Sheets

DILATANCY LIQUID

BACKGROUND OF THE INVENTION

1. Field of the Invention

The present invention relates to a dilatancy liquid.

A dilatancy liquid exhibits a high viscosity under a high shear stress, and a low viscosity under a low shear stress. It is disposed between two objects which are placed in proximity to each other and driven relatively. For example, it can be applied to a hydraulic fluid for a clutch which transmits a high torque under a high shear speed, and a low torque under a low shear speed, and it can be applied to a hydraulic fluid for a vibration isolator, etc.

2. Description of Related Art

It has been known that a liquid with fine particles dispersed therein exhibits a dilatancy property; namely: when a shear force is applied to such a liquid, the liquid exhibits a low viscosity under a low shear force, and increases its viscosity under an increasing shear force. This phenomenon is believed to occur in the following manner. A shear force changes the relative configuration of the fine particles in the liquid to enlarge free spaces existing among the fine particles. A negative-pressure action arises to fill up the enlarged free spaces with the surrounding liquid, thereby attracting the fine particles to each other. Thus, the liquid exhibits an increasing resistance.

"DILATAL (trade mark)" has been known as one of the liquids exhibiting the dilatancy property, and made by a German company, BASF. This dilatancy liquid includes water, and an acrylic ester-styrene copolymer dispersed in water.

The conventional dilatancy liquid suffered from a poor mechanical strength, because its dispersing particles are made from a resin. Moreover, after the conventional dilatancy liquid is subjected to a displacement, such as a shear force, it takes a few seconds and up to a couple of minutes for the conventional dilatancy liquid to exhibit the dilatancy property and to respond to the displacement.

SUMMARY OF THE INVENTION

The present invention has been developed in view of the aforementioned circumstances. It is therefore an object of the present invention to provide a novel dilatancy liquid which is of high mechanical strength, and exhibits a low viscosity under a low shear stress and a high viscosity under a high shear stress; namely: it exhibits a large viscous-resistance variation by a shear-stress increment.

The present invention was based on the following accidental discovery which was made by the inventors of the present invention; namely: a liquid was found to exhibit an extremely good dilatancy property when inorganic particles of especially high roundness were dispersed therein.

For instance, a dilatancy liquid according to the present invention is a sol under a low shear stress and a gel under a high shear stress, and comprises inorganic particles having a roundness of 1.1 or less, and a particle diameter of from 0.05 to 5 $\mu$m, and a liquid held among the inorganic particles.

It is preferable that, in the present dilatancy liquid, the inorganic particles are present in an amount of from 300 to 600 parts by weight, and the liquid is present in an amount of from 100 to 200 parts by weight.

The inorganic particles, constituting the present dilatancy liquid, have a roundness of 1.1 or less. Preferably, they have a roundness of 1.01 or less which can be approximated to 1 as much as possible. In terms of physical property, it is still indefinite why particles having a roundness close to 1 as much as possible are appropriate for dilatancy particles. However, round particles having a roundness close to 1 show a high flowability, and exhibit a low viscosity under a low shear stress at least. Accordingly, when the viscosity of such round particles under a low shear force is compared with the viscosity thereof under a high shear stress, there arises a large variation in the viscous resistance. This large viscous-resistance variation is believed to be one of the causes which result in the good dilatancy property.

The inorganic particles preferably have a particle diameter of from 0.05 to 5 $\mu$m, further preferably from 0.1 to 1.5 $\mu$m. It is unpreferable that the inorganic particles have an extremely large particle diameter, because such particles disperse unstably in the liquid (i.e., a solvent or dispersant), and settle to separate from the liquid. It is also unpreferable that the inorganic particles have an extremely small particle diameter, because the resulting liquid exhibits an increasing viscosity when it is a sol, and can hardly exhibit a typical dilatancy property.

It is preferable that the surface of the inorganic particles has irregularities as less as possible, or are flat as much as possible. It is believed that the flatter the surface of the inorganic particles is, the smaller the resistance arises among the inorganic particles when the inorganic particles slide with each other.

In terms of chemical composition, it is preferable that the inorganic particles include oxide or nitride which includes Si, Al, Mg or Zr. This oxide or nitride is hard, and stable chemically. Accordingly, such inorganic particles are less likely to crack or deteriorate during service. It is possible to exemplify silica, alumina, magnesia or zirconia particles as the specific inorganic particles. Further, it is possible to exemplify ADMAFINE "SO-C2" (trade mark) particles, which are made by AD-MATEX, Co., Ltd., as one of the silica particles. ADMAFINE "SO-C2" (trade mark) particles have an average particle diameter of 0.5 $\mu$m, a particle-diameter distribution of from 0.1 to 1 $\mu$m, and a completely sphere shape. Furthermore, it is possible to exemplify ADMAFINE "AO-502" (trade mark) particles, which are made by AD-MATEX, Co., Ltd., as one of the alumina particles. ADMAFINE "AO-502" (trade mark) particles have an average particle diameter of 0.7 $\mu$m, a particle-diameter distribution of from 0.1 to 1.1 $\mu$m, and a completely sphere shape.

As for the liquid (i.e., a solvent or dispersant), constituting the present dilatancy liquid, it is preferable to employ a low-molecular-weight liquid which can disperse the inorganic particles stably therein. Under certain temperature conditions, it is preferable to employ a high-boiling-point liquid. The following liquids satisfy these requirements; namely: lower alcohols, lower glycols, glycol ethers, and aqueous solutions thereof. It is possible to exemplify an aqueous solution of ethylene glycol.

In order to stably disperse the inorganic particles, it is possible to combine the inorganic particles and the liquid which have similar physical properties to each other. As one of the physical properties, it is possible to exemplify polarity. Many inorganic particles are highly polarized on their surfaces. Accordingly, it is recommended to employ a highly hydrophilic liquid.

Moreover, it is possible to modify the surface of the inorganic particles to give a lipophilic property. If such is the case, a lipophilic liquid can be employed. It is possible to exemplify esterification and halogenation as a process for giving a lipophilic property to the surface of the inorganic particles.

In esterification, the inorganic particles are heated in alcohol for a prolonged period of time. The alcohol is heated to a high temperature, and is highly pressurized. Thus, the inorganic particles react with the alcohol to esterify and fix the alcohol on their surface. The alcohol can be ethanol, butanol, propanol, or the like. The esterification can be carried out under the following reaction conditions; namely: heating at 150° C. for 12 hours. Note that the residual alcohol is evaporated to remove.

The halogenation can be carried out by using a halogenation agent, such as thionyl chloride ($SO_4Cl$), etc. For instance, 50 g silica and 20 c.c. $SO_4Cl$ are charged in an enclosed container which is lined with a fluorocarbon resin, and are reacted at 150° C. for 12 hours.

As another one of the physical properties of the inorganic particles and liquid, it is possible to exemplify their specific gravities. When the inorganic particles and liquid have specific gravities differing from each other, they are likely to separate by gravity. Accordingly, in order to produce stable dispersion, it is preferable that the inorganic particles and liquid have similar specific gravities as close as possible. For example, it is possible to enlarge the specific gravity of the liquid by dissolving an inorganic salt having a high specific gravity therein in order to approximate the specific gravity of the resulting mixture to the specific gravity of inorganic particles. Moreover, it is possible to employ a liquid of high specific gravity, such as halide, etc. The halide can be dibromomethane ($CH_2Br_2$), tetrabromomethane ($CHBr_3$), 1,2-dibromoethane ($CH_2BrCH_2Br$), and the like.

In addition, in order to stably disperse the inorganic particles in the liquid, it is possible to employ a known dispersion-improving agent. The dispersion-improving agent usually weakens the high polarity of the inorganic particles, and makes the inorganic particles less likely to agglomerate. In order to enhance the actions of the dispersion-improving agent, it is preferable to use a liquid of weak polarity, and at the same time to alkalify such a liquid weakly (e.g., to pH=6 to 11) in order to keep the corrosion resistance. The following liquids satisfy these requirements; namely: ammonia, aliphatic amines, etc. It is possible to exemplify triethanolamine ($N(C_2H_4O—H)_3$) as one of the aliphatic amines.

It is preferable that, in the present dilatancy liquid, the dispersion-improving agent is present in an amount of from 1 to 20 parts by weight.

It is possible to improve the flowability of the present dilatancy liquid by varying the dispersion of the inorganic particles; namely: by dissolving a flowability-improving agent into the present dilatancy liquid so as to control the polarity of the dilatancy liquid. It has been known generally that, when an electrolyte of strong polarity, such as a salt, is dissolved into a liquid in which fine inorganic particles of strong polarity are dispersed, the fine inorganic particles usually agglomerate. However, the inventors of the present invention discovered that the viscosity of the resulting dilatancy liquid can be lowered contrarily, and the flowability thereof can be improved by adding specific inorganic particles and by adjusting the addition amount of specific inorganic particles.

The mechanism for improving the flowability of the present dilatancy liquid is believed as follows; namely: the inorganic particles gather around the electrolyte ions to form clusters. The resulting clusters apparently behave like particles having a large particle diameter. As a result, the flowability of the present dilatancy liquid is improved under a low shear region. The following strong electrolytes can carry out the mechanism appropriately; namely: NaCl, KCl, LiCl, $CaCl_2$, $MgCl_2$, $NaNO_3$, $Na_2MoO_4$, $Na_2SO_4$, and $NaH_2PO_4$.

It is preferable that, in the present dilatancy liquid, the flowability-improving agent is present in an amount of from 1 to 20 parts by weight.

The dilatancy property is a phenomenon which results from a temporary change in the packed state of particles. The temporary change is caused by an abrupt dislocation. Therefore, it is necessary to closely pack particles in the liquid (i.e., a solvent or dispersant). In addition, it is further necessary to satisfy the following requirements at the same time; namely: a dilatancy liquid flows smoothly in normal state or under a low shear stress, and responds quickly to a displacement under a high shear stress.

In order to closely pack the inorganic particles, it is preferable to prepare the present dilatancy liquid in the following order; namely: fine inorganic particles are charged in a mixed solution of the liquid (i.e., a solvent or dispersant) and a dispersion improving agent by a small amount, and are stirred to disperse therein, until all of the fine inorganic particles are charged. Thereafter, the resulting dispersion is stirred to mix in a ball mill for a long period of time, for instance, 24 hours. No satisfactory dispersion is established when all of fine inorganic particles are charged in the liquid at once, or when the liquid is contrary charged to fine inorganic particles. If such is the case, sedimentation may occur in the resulting dispersion, or the resulting dispersion may lack stability.

In accordance with the present invention, the inorganic particles of extremely high roundness are dispersed in the present dilatancy liquid. The inorganic particles are likely to be packed closely in the liquid (i.e., a solvent or dispersant), because they have an extremely high roundness. Accordingly, the packed state of the inorganic particles can be changed remarkably by applying a high shear stress. As a result, the present dilatancy liquid can exhibit a dilatancy property in a short period of time.

Further, the present dilatancy liquid can exhibit a low viscous resistance and flow smoothly in normal state or under a low shear stress, because the inorganic particles have an extremely high roundness. Furthermore, the present dilatancy liquid is strong mechanically, and stable thermally, because the inorganic particles include the inorganic compounds.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

First Preferred Embodiment

The First Preferred Embodiment of the present dilatancy liquid comprised silica particles in an amount of 400 parts by weight, pure water in an amount of 100 parts by weight, and a 10% ammonium aqueous solution in an amount of 5 parts by weight. Note that ADMAFINE "SO-C2" (trade mark) particles having an average particle diameter of 0.5 $\mu$m, and a roundness of less than 1.01 (i.e., <1.01) were used as the silica particles. This dilatancy liquid was prepared as follows; namely: the pure water and 10% ammonium aqueous solution were first mixed, and then silica particles were gradually added to the mixture. Finally, the entire mixture was stirred and mixed in a ball mill for 48 hours.

Figure 1:
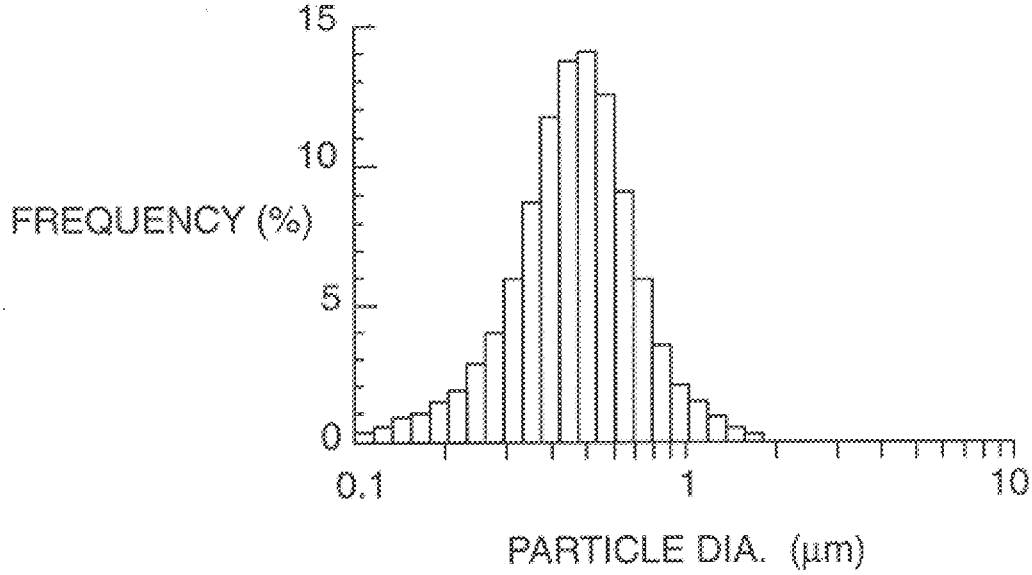
FIG. 1 is a bar chart for illustrating a particle-diameter distribution of silica particles which were employed in a First Preferred Embodiment of a dilatancy liquid according to the present invention.
Figure 2:
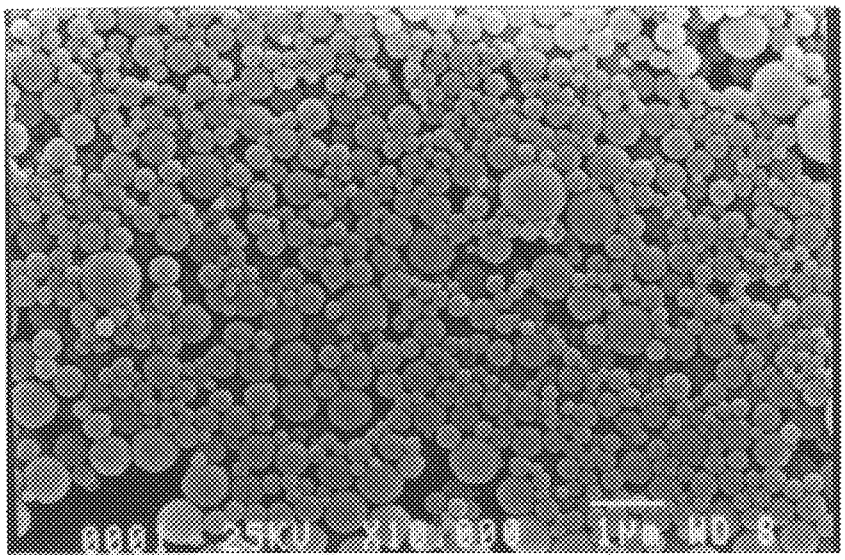
FIG. 2 is a photomicrograph for showing the silica particles which were employed in the First Preferred Embodiment of the present dilatancy liquid.

FIG. 1 illustrates a particle-diameter distribution of the employed silica particles. FIG. 2 is a photomicrograph of the employed silica particles.

The thus prepared dilatancy liquid was evaluated for the dilatancy property by using a coaxial-dual-cylinder type viscometer, "Rheomat 115". The viscometer was made by K. K. Codex Co., Ltd., and had a rotor whose type was "MS-HS-125/36". Specifically, in the evaluation, the dilatancy liquid was examined for a relationship between a shear speed ($s^{-1}$) and a viscosity (mPa·s) with the viscometer In order to evaluate the dilatancy property, the viscosity was expressed in terms of an index, (shear stress/shear speed). The index was used because it helps evaluate the dilatancy property by means of graphic configuration with ease. Note that, in the evaluation, the revolving speed of the rotor was increased from 6 rpm/s to 730 rpm/s, and the viscosity was measured at each of shear speeds.

Figure 3:
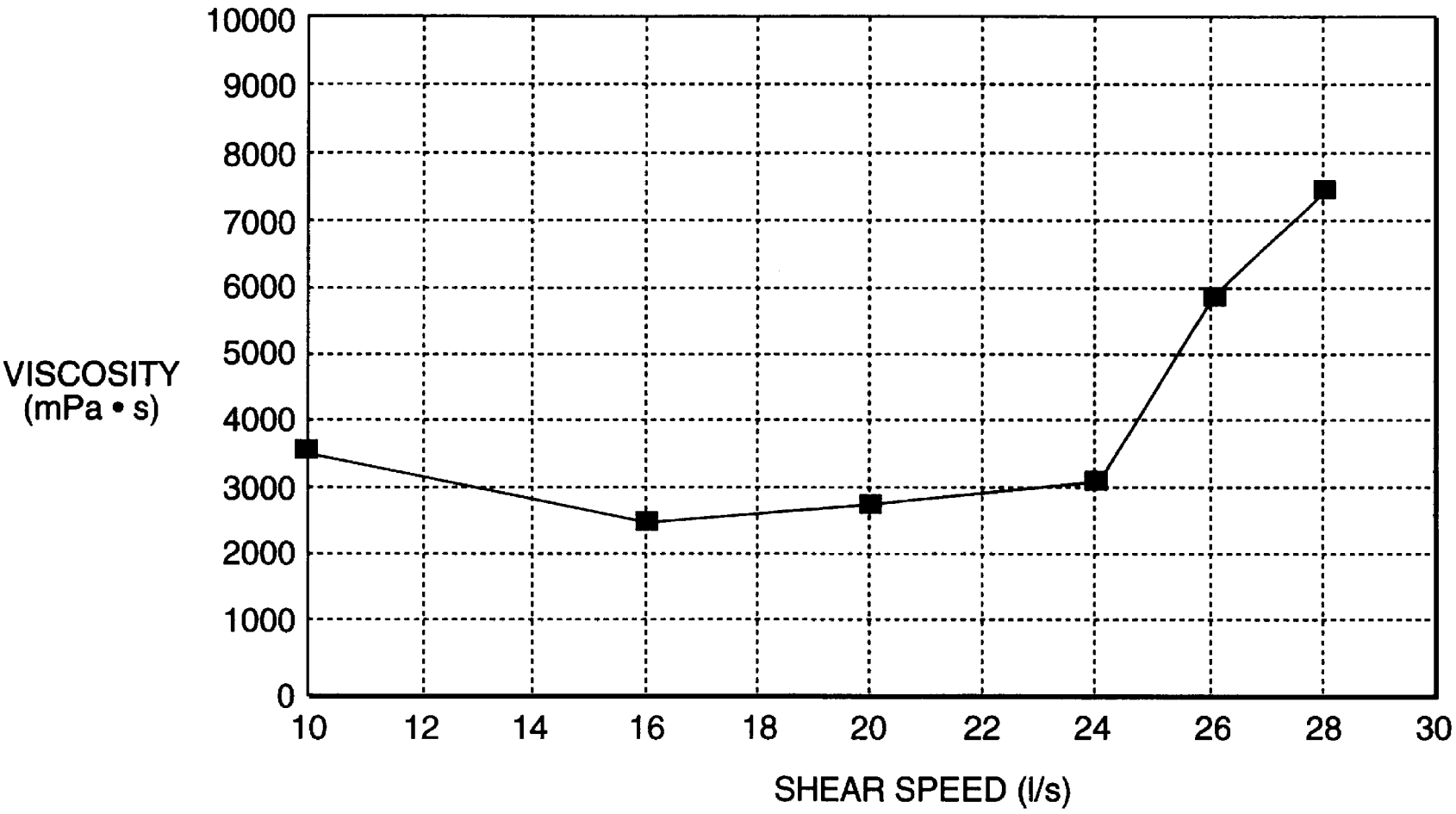
FIG. 3 is a diagram for illustrating a relationship between a shear speed and a viscosity, relationship which was exhibited by the First Preferred Embodiment of the present dilatancy liquid.

FIG. 3 illustrates the results of the evaluation. It is appreciated from FIG. 3 that the First Preferred Embodiment exhibited a viscosity of 3,100 (mPa·s) at a shear speed of 24 ($s^{-1}$), exhibited a viscosity of 5,900 (mPa·s) at a shear speed of 26 ($s^{-1}$), and exhibited a viscosity of 7,500 (mPa·s) at a shear speed of 28 ($s^{-1}$). Thus, the First Preferred Embodiment was verified to exhibit a sharp viscosity increment with a slight shear speed variation.

The First Preferred Embodiment of the present dilatancy liquid having the aforementioned composition was a liquid. When a "B"-type viscometer was used to examine the viscosity of the First Preferred Embodiment, the First Preferred Embodiment exhibited a viscosity of 7,500 cP at a shear speed of 30 rpm. Note that the dilatancy property of the present dilatancy liquid can be varied by changing the content of the inorganic particles (i.e., the silica particles) and the liquid (i.e., pure water). For example, the content of pure water fell in a range of from 65 to 170 parts by weight with respect to 400 parts by weight of ADMAFINE "SO-C2" (trade mark) particles. When the content of pure water was less than 65 parts by weight with respect thereto, no liquid was prepared. When the content of pure water was more than 170 parts by weight with respect thereto, the resulting liquid did not exhibit a dilatancy property.

Second Preferred Embodiment

The Second Preferred Embodiment of the present dilatancy liquid comprised silica particles in an amount of 400 parts by weight, pure water in an amount of 53.2 parts by weight, ethylene glycol in an amount of 53.2 parts by weight, and a 10% ammonium aqueous solution in an amount of 1.3 parts by weight. Note that ADMAFINE "SO-C2" (trade mark) particles having an average particle diameter of 0.5 $\mu$m, and a roundness of less than 1.01 (i.e., <1.01) were used as the silica particles. Thus, in the Second Preferred Embodiment, the ethylene glycol substituted for part of the pure water in the First Preferred Embodiment.

The Second Preferred Embodiment exhibited a virtually identical dilatancy property with that of the First Preferred Embodiment.

When a "B"-type viscometer was used to examine the viscosity of the Second Preferred Embodiment, the Second Preferred Embodiment exhibited a viscosity of 7,000 cP at a shear speed of 30 rpm. The Second Preferred Embodiment could be used in a temperature range of from −35° C. to 110° C. under ordinary pressure.

Note that, instead of the pure water and ethylene glycol, it is possible to prepare the present dilatancy liquid by using the other alcohols, glycols, glycol ethers, and aqueous solutions thereof. By employing these various liquids, it is possible to vary or enlarge the service temperature range of the present dilatancy liquid.

Third Preferred Embodiment

The Third Preferred Embodiment of the present dilatancy liquid comprised silica particles in an amount of 400 parts by weight, pure water in an amount of 53.2 parts by weight, ethylene glycol in an amount of 53.2 parts by weight, and triethanolamine in an amount of 3 parts by weight. Note that ADMAFINE "SO-C2" (trade mark) particles having an average particle diameter of 0.5 $\mu$m, and a roundness of less than 1.01 (i.e., <1.01) were used as the silica particles. Thus, in the Third Preferred Embodiment, the tri-ethanolamine substituted for the 10% ammonium aqueous solution in the Second Preferred Embodiment.

The Third Preferred Embodiment exhibited a virtually identical dilatancy property with that of the First Preferred Embodiment.

When a "B"-type viscometer was used to examine the viscosity of the Third Preferred Embodiment, the Third Preferred Embodiment exhibited a viscosity of 7,000 cP at a shear speed of 30 rpm.

The Third Preferred Embodiment verified that aliphatic amines can be used instead of the 10% ammonium aqueous solution. Note that, when the triethanolamine is used as in the Third Preferred Embodiment, the dispersion stability of the silica particles can be improved so as to produce a system which is stable for a much longer period of time.

Fourth Preferred Embodiment

The Fourth Preferred Embodiment of the present dilatancy liquid comprised first silica particles in an amount of 320 parts by weight, second silica particles in an amount of 80 parts by weight, pure water in an amount of 61.4 parts by weight, ethylene glycol in an amount of 61.4 parts by weight, and a 10% ammonium aqueous solution in an amount of 2 parts by weight. Note that ADMAFINE "SO-C2" (trade mark) particles having an average particle diameter of 0.5 $\mu$m, and a roundness of less than 1.01 (i.e., <1.01) were used as the first silica particles, and that ADMAFINE "SO-E5" (trade mark) particles having an average particle diameter of 1.5 $\mu$m, and a roundness of less than 1.01 (i.e., <1.01) were used as the second silica particles.

Figure 4:
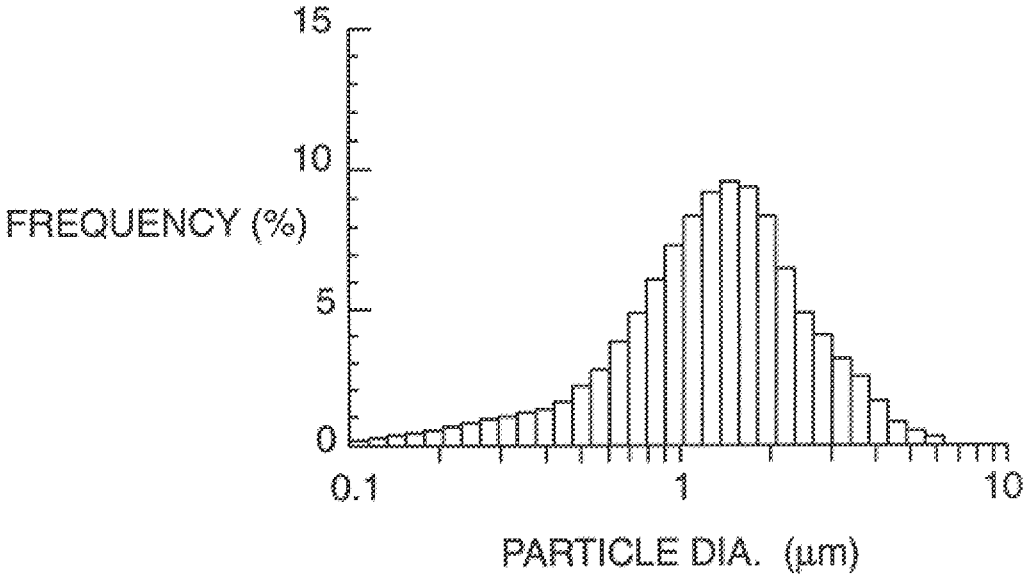
FIG. 4 is a bar chart for illustrating a particle-diameter distribution of silica particles which were employed in a Fourth Preferred Embodiment of a dilatancy liquid according to the present invention.
Figure 5:
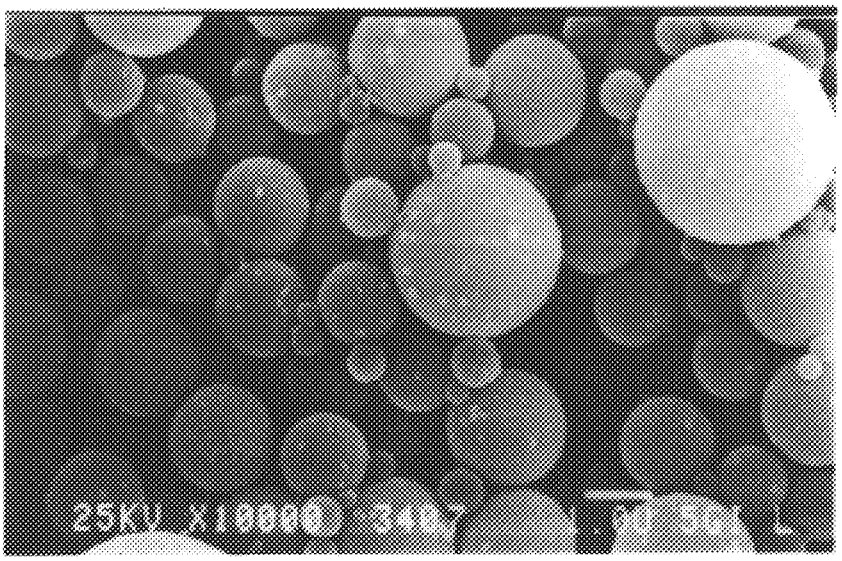
FIG. 5 is a photomicrograph for showing the silica particles which were employed in the Fourth Preferred Embodiment of the present dilatancy liquid.

FIG. 4 illustrates a particle-diameter distribution of the newly employed second silica particles. FIG. 5 is a photomicrograph of the newly employed second silica particles.

The thus prepared dilatancy liquid was evaluated for the dilatancy property by using the same viscometer as used in the First Preferred Embodiment. Note that, however, the viscometer had a rotor whose type was "MS-DIN-145/108".

Figure 6:
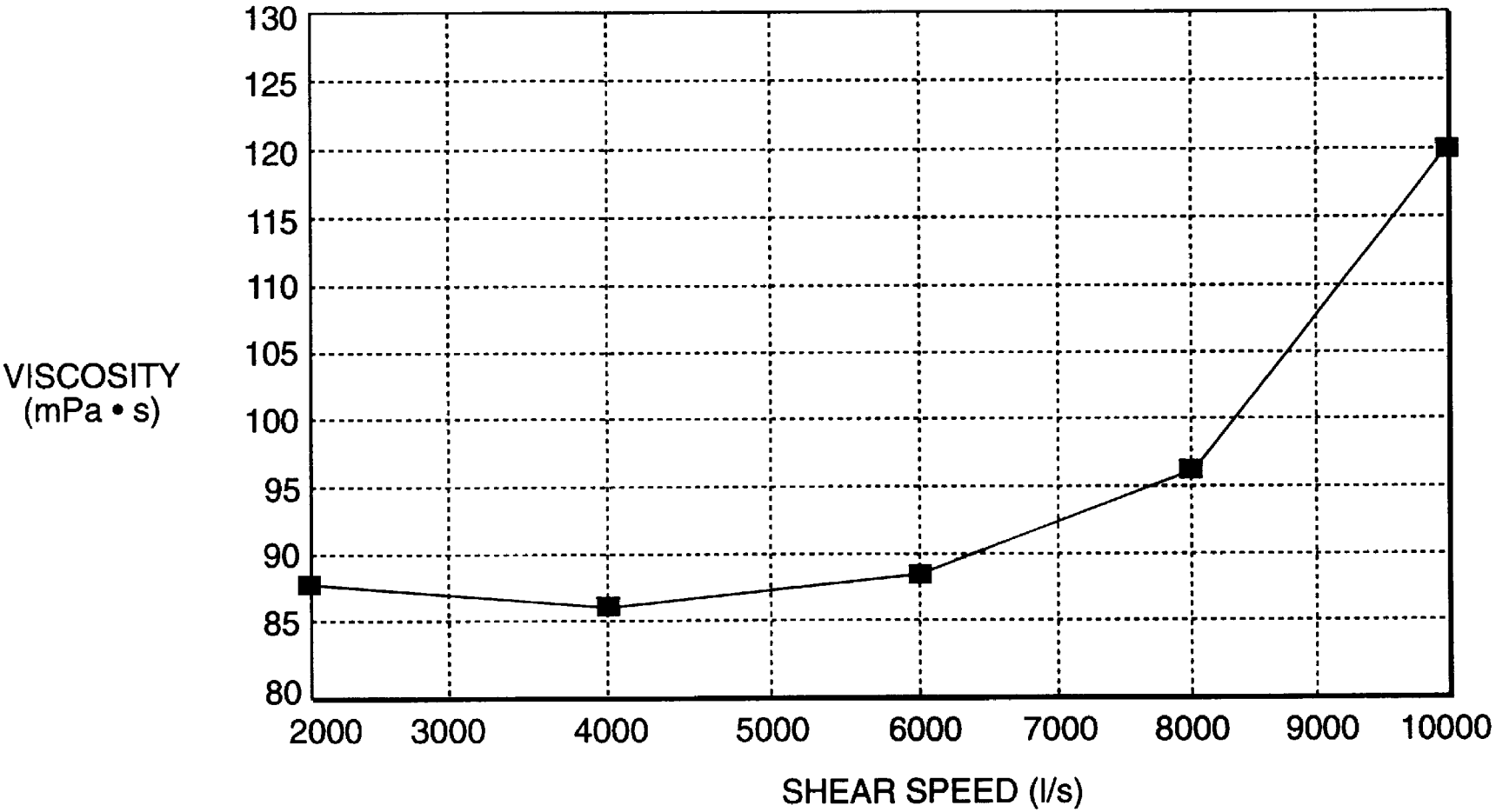
FIG. 6 is a diagram for illustrating a relationship between a shear speed and a viscosity, relationship which was exhibited by the Fourth Preferred Embodiment of present dilatancy liquid.

FIG. 6 illustrates the results of the evaluation. It is appreciated from FIG. 6 that the Fourth Preferred Embodiment exhibited a viscosity of 96 (mPa·s) at a shear speed of 8,000 ($s^{-1}$), and exhibited a viscosity of 120 (mPa·s) at a shear speed of 10,000 ($s^{-1}$). Accordingly, the Fourth Preferred Embodiment exhibited a viscosity increment of 1.25 times with respect to the shear speed variation of from 8,000 ($s^{-1}$) to 10,000 ($s^{-1}$). Thus, the Fourth Preferred Embodiment was a high shear-speed-transition type dilatancy liquid.

When a "B"-type viscometer was used to examine the viscosity of the Fourth Preferred Embodiment, the Fourth Preferred Embodiment exhibited a viscosity of 4,000 cP at a shear speed of 30 rpm.

The Fourth Preferred Embodiment verified that, without changing the content of the inorganic particles, the viscosity of the present dilatancy liquid can be modified by varying the average particle diameter or particle-diameter distribution of the inorganic particles. For instance, the fluid viscosity of the present dilatancy liquid can be decreased by enlarging the average particle diameter of the inorganic particles.

Fifth Preferred Embodiment

The Fifth Preferred Embodiment of the present dilatancy liquid comprised alumina particles in an amount of 570 parts by weight, pure water in an amount of 100 parts by weight, and a 10% ammonium aqueous solution in an amount of 10 parts by weight. Note that ADMAFINE "AO-502" (trade mark) particles having an average particle diameter of 0.7 $\mu$m, and a roundness of less than 1.01 (i.e., <1.01) were used as the alumina particles.

Figure 7:
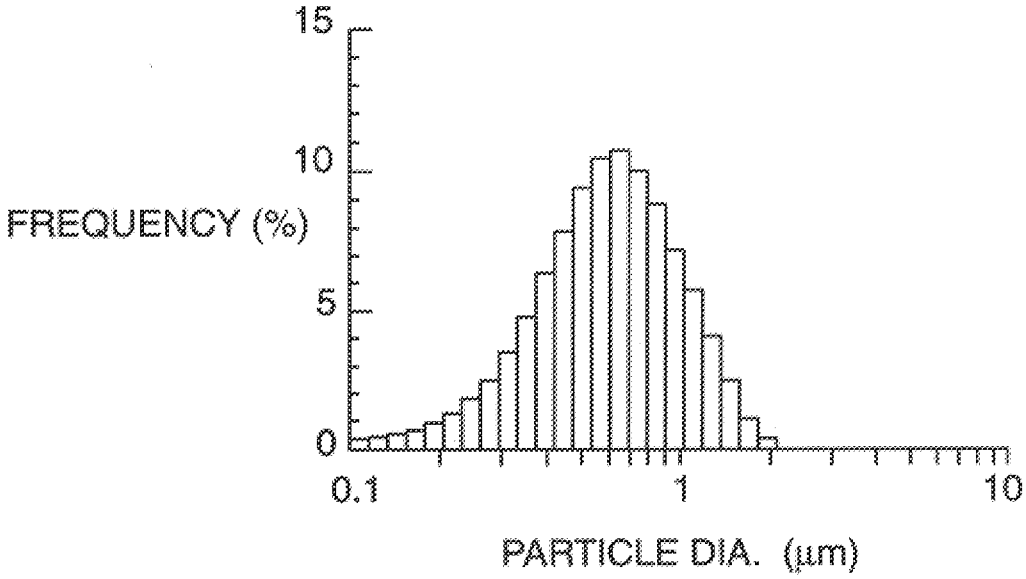
FIG. 7 is a bar chart for illustrating a particle-diameter distribution of alumina particles which were employed in a Fifth Preferred Embodiment of a dilatancy liquid according to the present invention.
Figure 8:
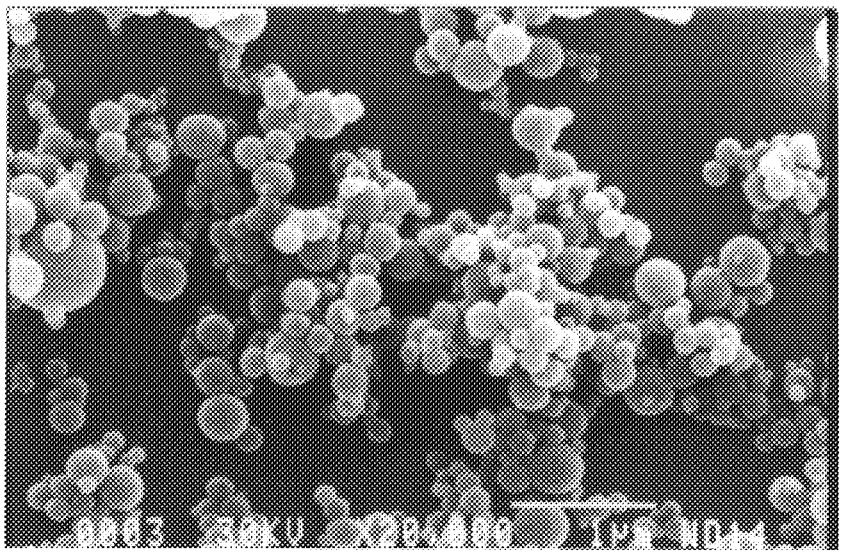
FIG. 8 is a photomicrograph for showing the alumina particles which were employed in the Fifth Preferred Embodiment of the present dilatancy liquid.

FIG. 7 illustrates a particle-diameter distribution of the alumina particles. FIG. 8 is a photomicrograph of the alumina particles.

When a "B"-type viscometer was used to examine the viscosity of the Fifth Preferred Embodiment, the Fifth Preferred Embodiment exhibited a viscosity of 11,000 cP at a shear speed of 30 rpm.

The Fifth Preferred Embodiment verified that, instead of the inorganic particles employed in the First through Fourth Preferred Embodiments, the present dilatancy liquid can comprise the other inorganic particles. In addition to the complete-sphere-shaped silica particles, the present dilatancy liquid can comprise the other complete-sphere-shaped inorganic particles, such as the complete-sphere-shaped alumina, magnesia or zirconia particles.

Sixth Preferred Embodiment

The Sixth Preferred Embodiment of the present dilatancy liquid comprised esterified silica particles in an amount of 400 parts by weight, and benzyl alcohol in an amount of 100 parts by weight. Note that ADMAFINE "SO-C2" (trade mark) particles having an average particle diameter of 0.5 $\mu$m, and a roundness of less than 1.01 (i.e., <1.01) were used as the esterified silica particles, and that they were esterified. In the esterification, the silica particles and alcohol were mixed with each other, and were charged in an enclosed container to react at 150° C. for 12 hours. Note that the residual alcohol was evaporated to remove.

When a "B"-type viscometer was used to examine the viscosity of the Sixth Preferred Embodiment, the Sixth Preferred Embodiment exhibited a viscosity of 8,000 cP at a shear speed of 30 rpm.

Note that, instead of the benzyl alcohol, it is possible to employ higher alcohols, halides, and silicone oils as the liquid.

Seventh Preferred Embodiment

The Seventh Preferred Embodiment of the present dilatancy liquid comprised esterified silica particles in an amount of 375 parts by weight, and tetrabromoethane in an amount of 141 parts by weight, and benzyl alcohol in an amount of 31 parts by weight. Note that the esterified silica particles were identical with those of the Sixth Preferred Embodiment; namely: ADMAFINE "SO-C2" (trade mark) particles having an average particle diameter of 0.5 $\mu$m, and a roundness of less than 1.01 (i.e., <1.01) were esterified. Also note that the tetrabromoethane had a specific gravity of 2.9, and the benzyl alcohol had a specific gravity of 1.04. Accordingly, the mixture of the 141-part-by-weight tetrabromoethane and the 31-part-by weight benzyl alcohol had a specific gravity of about 2.2 which was equal to those of the silica powders.

When a "B"-type viscometer was used to examine the viscosity of the Seventh Preferred Embodiment, the Seventh Preferred Embodiment exhibited a viscosity of 9,000 cP at a shear speed of 30 rpm.

In a dilatancy liquid like the Seventh Preferred Embodiment, the dispersant and the dispersing substances have an equal specific gravity. As a result, when a gravitational force and a centrifugal force are applied to such a dilatancy liquid, the dispersant and the dispersing substances do not separate from each other. Therefore, the Seventh Preferred Embodiment could be used at places where heavy centrifugal forces acted thereto.

Eighth Preferred Embodiment

The Eighth Preferred Embodiment of the present dilatancy liquid comprised chlorinated silica particles in an amount of 375 parts by weight, tetrabromoethane in an amount of 141 parts by weight, and benzyl alcohol in an amount of 31 parts by weight. Note that ADMAFINE "SO-C5" (trade mark) particles having an average particle diameter of 1.5 $\mu$m, and a roundness of less than 1.01 (i.e., <1.01) were used as the chlorinated silica particles, and that they were chlorinated. In the chlorination, the silica particles were charged in an amount of 50 g in an enclosed container which was lined with a fluorocarbon resin, and in which thionyl chloride ($SO_4Cl$) was held in an amount of 20 c.c. The silica particles were reacted with the thionyl chloride at 150° C. for 12 hours, and thereby their surfaces were chlorinated.

When a "B"-type viscometer was used to examine the viscosity of the Eighth Preferred Embodiment, the Eighth Preferred Embodiment exhibited a viscosity of 7,000 cP at a shear speed of 30 rpm.

Ninth Preferred Embodiments

The Ninth Preferred Embodiments of the present dilatancy liquid were prepared by adding a flowability-improving agent to the Fourth Preferred Embodiment of the present dilatancy liquid. Specifically, the Ninth Preferred Embodiments were prepared by dissolving one of the following inorganic salts into the Fourth Preferred Embodiment in a predetermined amount; namely: NaCl, LiCl, $Na_2MoO_4$, and $Na_2SO_4$.

One of the Ninth Preferred Embodiments, e.g., the present dilatancy liquid with a monovalent salt (i.e., a flowability-improving agent) dissolved therein by an ion-equivalent unit, was prepared as follows; namely: a monovalent salt (e.g., NaCl or LiCl) was dissolved into water to prepare a 2 mol/kg aqueous solution. The aqueous solution was weighed out by 3.9 g, and added to 1,000 g of the Fourth Preferred Embodiment. The resulting mixture was mixed by a ball mill to prepare a dispersion.

Further, the present dilatancy liquid with a monovalent salt dissolved therein by two ion-equivalent units was prepared by adding the 2 mol/kg monovalent-salt aqueous solution in a twice amount of 7.8 g to 1,000 g of the Fourth Preferred Embodiment and following the procedure; the present dilatancy liquid with a monovalent salt dissolved therein by three ion-equivalent units was prepared by adding the 2 mol/kg monovalent-salt aqueous solution in a three-time amount of 11.7 g to 1,000 g of the Fourth Preferred Embodiment and following the procedure; and the present dilatancy liquid with a monovalent salt dissolved therein by four ion-equivalent units was prepared by adding the 2 mol/kg monovalent-salt aqueous solution in a four-time amount of 15.6 g to 1,000 g of the Fourth Preferred Embodiment and following the procedure.

Furthermore, the present dilatancy liquid with a divalent salt (e.g., $Na_2MoO_4$ or $Na_2SO_4$) dissolved therein by an ion-equivalent unit were prepared by adding a 2 mol/kg divalent-salt aqueous solution in an amount of 1.95 g to 1,000 g of the Fourth Preferred Embodiment and following the procedure.

Likewise, the present dilatancy liquid with a divalent salt dissolved therein by two ion-equivalent units was prepared by adding the 2 mol/kg divalent-salt aqueous solution in a twice amount of 3.9 g to 1,000 g of the Fourth Preferred Embodiment and following the procedure; the present dilatancy liquid with a divalent salt dissolved therein by three ion-equivalent units was prepared by adding the 2 mol/kg divalent-salt aqueous solution in a three-time amount of 5.85 g to 1,000 g of the Fourth Preferred Embodiment and following the procedure; and the present dilatancy liquid with a divalent salt dissolved therein by four ion-equivalent units was prepared by adding the 2 mol/kg divalent-salt aqueous solution in a four-time amount of 7.8 g to 1,000 g of the Fourth Preferred Embodiment and following the procedure.

Figure 9:
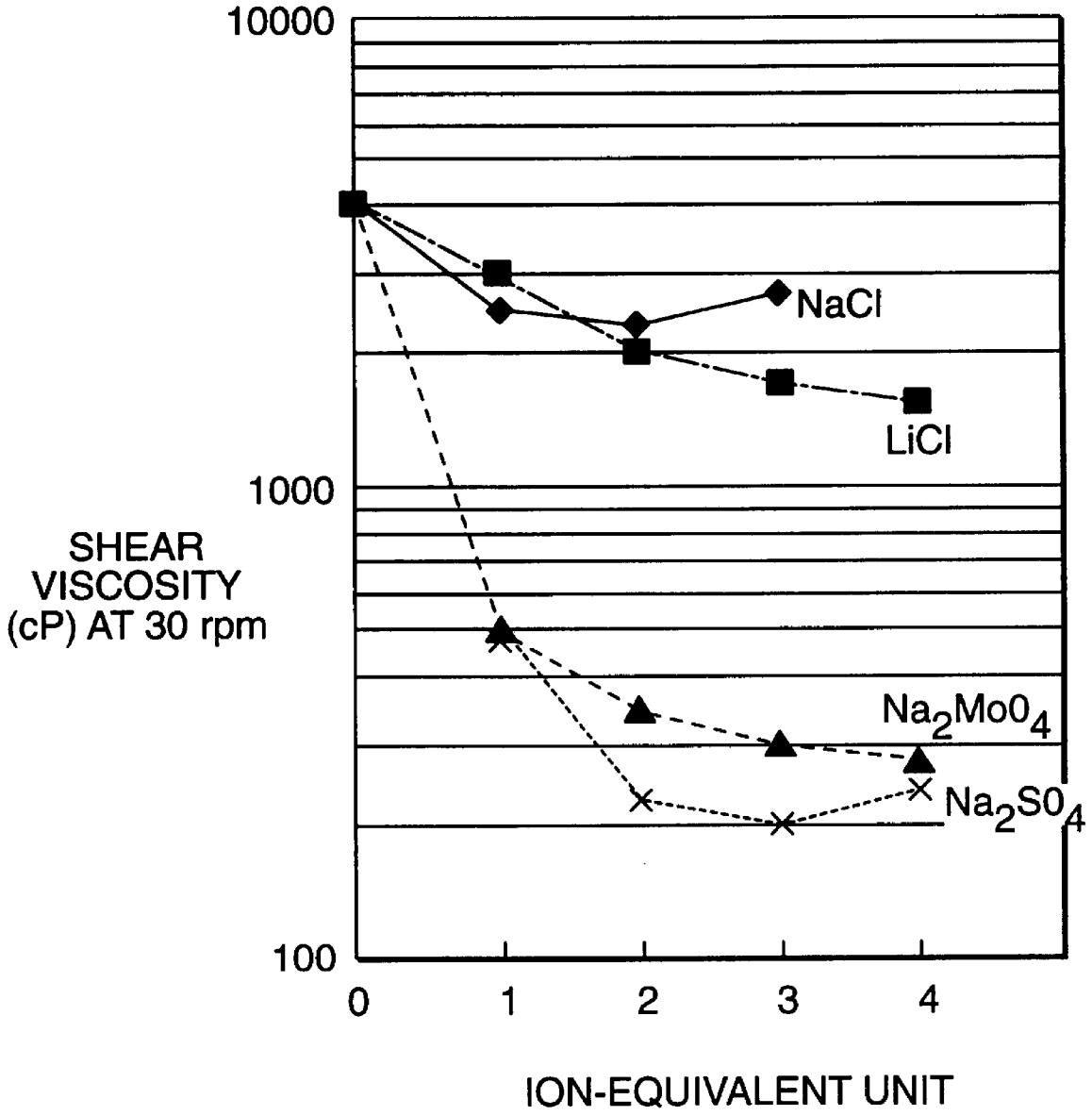
FIG. 9 is a diagram for illustrating relationships between an ion-equivalent unit of added strong electrolytes and a shear viscosity, relationships which were exhibited by Ninth Preferred Embodiments of a dilatancy liquid according to the present invention.

The resulting Ninth Preferred Embodiments of the present dilatancy liquid were examined for their viscosity at a shear speed of 30 rpm by using a "B"-type viscometer. FIG. 9 illustrates the results of this examination. The horizontal axis of FIG. 9 specifies the ion-equivalent unit of the salts dissolved in the Ninth Preferred Embodiments, and the vertical axis of FIG. 9 specifies the shear viscosity exhibited by the Ninth Preferred Embodiments. It is apparent from FIG. 9 that the shear viscosity of the present dilatancy liquid can be decreased by adding the salt of strong electrolytes, such as NaCl, LiCl, $Na_2MoO_4$, and $Na_2SO_4$.

Having now fully described the present invention, it will be apparent to one of ordinary skill in the art that many changes and modifications can be made thereto without departing from the spirit or scope of the present invention as set forth herein including the appended claims.

What is claimed is:

1. A dilatancy liquid being a sol under a low shear stress and a gel under a high shear stress, said dilatancy liquid comprising:

inorganic particles having a roundness of 1.1 or less, and a particle diameter of from 0.05 to 5 $\mu$m, and being present in an amount of from about 300 to about 600 parts by weight; and a liquid held among said inorganic particles, and being present in an amount of from about 100 to about 200 parts by weight.

2. The dilatancy liquid according to claim 1, wherein said inorganic particles have a roundness of 1.01 or less.

3. The dilatancy liquid according to claim 1, wherein said inorganic particles have a particle-diameter distribution of from 0.1 to 1.5 $\mu$m.

4. The dilatancy liquid according to claim 1, wherein said inorganic particles include at least one compound selected from the group consisting of oxide and nitride, the oxide and nitride including at least one element selected from the group consisting of Si, Al, Mg, and Zr.

5. The dilatancy liquid according to claim 1, wherein said liquid includes a dispersion-improving agent.

6. The dilatancy liquid according to claim 1, wherein said liquid includes a flowability-improving agent.

7. The dilatancy liquid according to claim 1, wherein said liquid has a specific gravity of from 90 to 110 with respect to an absolute specific gravity of said inorganic particles taken as 100.

8. The dilatancy liquid according to claim 1, wherein said liquid is an aqueous solution.

9. The dilatancy liquid according to claim 1, wherein said liquid is an organic liquid.

10. The dilatancy liquid according to claim 9, wherein said organic liquid is a silicone oil.

11. The dilatancy liquid according to claim 9, wherein said organic liquid is at least one member selected from the group consisting of alcohol, carboxylic acid, and ester.

12. The dilatancy liquid according to claim 9, wherein said organic liquid is halide.

13. The dilatancy liquid according to claim 1, wherein said inorganic particles have a lipophilic surface.

14. The dilatancy liquid according to claim 13, wherein said inorganic particles are subjected to at least one treatment selected from the group consisting of halogenation, esterification, and alkylation.

15. The dilatancy liquid according to claim 1, wherein said inorganic particles are silica particles, and said liquid is water.

* * * * *